US010074250B2

(12) United States Patent
Kelsch et al.

(10) Patent No.: US 10,074,250 B2
(45) **Date of Patent: *Sep. 11, 2018**

(54) ANTI-THEFT DEVICE FOR MONITORING CONNECTION BETWEEN A MALE PLUG AND A FEMALE RECEPTACLE

(71) Applicants: Christopher A. Kelsch, Palm Harbor, FL (US); Chung-Ping Lee, Taoyuan (TW); Vanguard Products Group, Inc., Oldsmar, FL (US)

(72) Inventors: Christopher A. Kelsch, Palm Harbor, FL (US); Chung-Ping Lee, Taoyuan (TW); John N. Figh, Jr., Oldsmar, FL (US); Lucas P. Swartwood, Tampa, FL (US); Bruno M. L. Telles, Tampa, FL (US); Ryan G. Bernosky, San Antonio, FL (US)

(73) Assignee: Vanguard Products Group, Inc., Oldsmar, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/268,029

(22) Filed: Sep. 16, 2016

(65) Prior Publication Data

US 2017/0004688 A1 Jan. 5, 2017

Related U.S. Application Data

(63) Continuation of application No. 14/969,931, filed on Dec. 15, 2015, now Pat. No. 9,472,068.

(60) Provisional application No. 62/154,431, filed on Apr. 29, 2015, provisional application No. 62/091,978, filed on Dec. 15, 2014.

(51) Int. Cl.
*G08B 13/14* (2006.01)
*G08B 13/12* (2006.01)

(52) U.S. Cl.
CPC ..... *G08B 13/1445* (2013.01); *G08B 13/12* (2013.01); *G08B 13/1463* (2013.01)

(58) Field of Classification Search
None
See application file for complete search history.

(56) References Cited

U.S. PATENT DOCUMENTS 5,699,591 A 12/1997 Kane
6,285,283 B1 9/2001 Rand et al.
8,517,748 B1 * 8/2013 Kelsch ..... H01R 13/6397 200/51.09
8,696,377 B2 * 4/2014 Kelsch ..... H01R 13/6397 200/51.09

(Continued)

*Primary Examiner* — Julie Lieu
(74) *Attorney, Agent, or Firm* — Andriy Lytvyn; Smith & Hopen, P.A.

(57) ABSTRACT

An anti-theft device for monitoring connection between a male plug and a female receptacle. The male plug has a sheath enclosing a plurality of conductive pins. The sheath contains a tongue having a first retracted configuration when the male plug is outside the female receptacle and a second displaced configuration when the male plug is inserted in the female receptacle. In the second displaced configuration, the tongue engages at two conductive pins, thereby creating a closed electric circuit. An alarm module monitors the electric current flow within the electric circuit, and responsive to detecting an interruption in the electric current flow, the alarm module transmits an alarm signal.

17 Claims, 6 Drawing Sheets

*FIG. 1*

(56) References Cited

U.S. PATENT DOCUMENTS

| | | | | |
|---|---|---|---|---|
| 2014/0024259 | A1* | 1/2014 | Kelsch | H01R 13/6397<br>439/620.01 |
| 2015/0091729 | A1* | 4/2015 | Phillips | G08B 13/1427<br>340/568.2 |
| 2015/0112264 | A1* | 4/2015 | Kamen | A61M 5/14244<br>604/151 |
| 2015/0140847 | A1* | 5/2015 | Kanemura | H01R 13/4368<br>439/259 |
| 2015/0194777 | A1* | 7/2015 | Hsiang | H01R 24/62<br>439/351 |
| 2016/0012693 | A1* | 1/2016 | Sugar | G08B 13/1409<br>340/568.3 |

* cited by examiner

ANTI-THEFT DEVICE FOR MONITORING CONNECTION BETWEEN A MALE PLUG AND A FEMALE RECEPTACLE

PRIORITY CLAIM

This patent application is a continuation of and claims priority to U.S. patent application Ser. No. 14/969,931 entitled "An Anti-Theft Device for Monitoring Connection Between a Male Plug and a Female Receptacle" filed Dec. 15, 2015, which application claims priority to U.S. Provisional Patent Application Ser. No. 62/091,978 filed Dec. 15, 2014 entitled "Security Monitoring Device for a Universal Serial Bus Type C Connector," and U.S. Provisional Patent Application Ser. No. 62/154,431 filed Apr. 29, 2015 entitled "A Security Device for Monitoring Connection Between A Male Plug and A Female Port," all of which are incorporated herein by reference.

BACKGROUND OF THE INVENTION

1. Field of the Invention

This invention relates to merchandise anti-theft devices. More specifically, it relates to an anti-theft device intended for monitoring the connection between a male plug and receptacle of a Type C universal serial bus ("USB") or another connector.

2. Brief Description of the Related Art

Retailers often prefer to present their merchandise to consumers in a way that allows the consumers to touch, inspect, and otherwise interact with the products at a display counter. Many merchandise items, especially portable electronic devices, are relatively expensive and, therefore, are under a serious threat of theft. Retailers often face a dilemma pertaining to how to interactively display their merchandise to attract customers and increase sales, while, at the same time, safeguarding the merchandise against theft.

A number of anti-theft devices are known in the art. Some anti-theft solutions involve various types of brackets that secure an electronic gadget to the display counter. Others involve protective sheaths and cases. What is needed, however, is an anti-theft device that discretely monitors the electronic gadget against unauthorized removal from the display counter without interfering with its aesthetic or functional features.

Examples of such solutions are disclosed in U.S. Pat. Nos. 8,517,748 and 8,696,377. The anti-theft devices disclosed in those patents comprise a male USB plug that is inserted into a corresponding female USB, mini USB, or micro USB receptacle to supply an electric current to the gadget. The male plug has two conductive members electrically insulated from one another. When the male plug is within the receptacle, both conductive members of the male plug contact the inner conductive surface of the female USB receptacle, which closes an electric circuit between them. An alarm module is used to monitor this closed circuit and trigger an alarm when the circuit is broken.

The anti-theft device of the '748 and '377 patents, however, cannot be used to monitor the connection between a male plug and a receptacle of a Type C USB connector due to significant changes in the connector's structural configuration. Accordingly, there is a need for a new anti-theft device for monitoring the connection between a male plug and a female receptacle of a Type C USB connector without diminishing the functionality provided by the Type C USB connector.

SUMMARY OF THE INVENTION

The invention is an anti-theft device for monitoring an electronic device having a female receptacle. The anti-theft device includes an alarm module having two terminals. The alarm module monitors the flow of an electric current between the first and second terminals. The anti-theft device further includes a male plug having a sheath. In an embodiment, the male plug is configured for connection with a Type C universal serial bus (USB) female receptacle. A plurality of conductive pins are disposed within the sheath. At least two of the pins are configured to engage corresponding electrical contacts of the female receptacle when the male plug is inserted therein. A first pin is in electrical communication with a first terminal of the alarm module, and a second pin is in electrical communication with the second terminal of the alarm module. In an embodiment, the first and second pins do not engage the electrical contacts of the female receptacle when the male plug is inserted therein. Alternatively, the first and second pins may engage the electrical contacts of the female receptacle, but such engagement must not enable an electric current to flow between the first and second pins.

The sheath of the male plug contains a tongue. The tongue may either be integrated within the sheath or hingedly or movingly attached thereto. The tongue is either electrically conductive or at least has an electrically conductive surface. The tongue has a first retracted position in which the conductive surface is retracted away from the plurality of conductive pins, and a second displaced position in which the conductive surface engages the first and the second pins. When the tongue is in the second displaced position, the electric current can flow between the first and second pins and, therefore, between the first and second terminals of the alarm module.

Insertion of the male plug into the female receptacle transitions the tongue into the second displaced position in which the conductive surface of the tongue becomes an electrical conduit between the first and second pins. In an embodiment, insertion of the male plug into a female receptacle elastically deforms the tongue. The tongue may have a sloped raised portion protruding beyond an outer surface of the sheath. Insertion of the male plug into the female receptacle causes a shell of the female receptacle to exert a force onto the sloped raised portion sufficient to transition the tongue into the second displaced position. Removal of the male plug from the female receptacle causes the tongue to return into the first retracted position.

The alarm module supplies the electric current to the first terminal and detects the electric current flowing to the second terminal. The alarm module is configured to transmit an alarm signal responsive to detecting an interruption in the flow of the electric current between the first and second terminals.

In another embodiment, the pin engaged by the tongue is connected to the first terminal of the alarm module, while the sheath of the male plug is connected to the second terminal. The sheath and the tongue are in electrical communication with one another. Accordingly, when the tongue is in the second displaced position, the tongue is in electrical communication with the pin, thereby closing the circuit between the first and second terminals of the alarm module. The alarm module monitors the circuit and transmits an alarm signal responsive to an interruption of the flow of the electric current within the circuit.

DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

Figure 1:
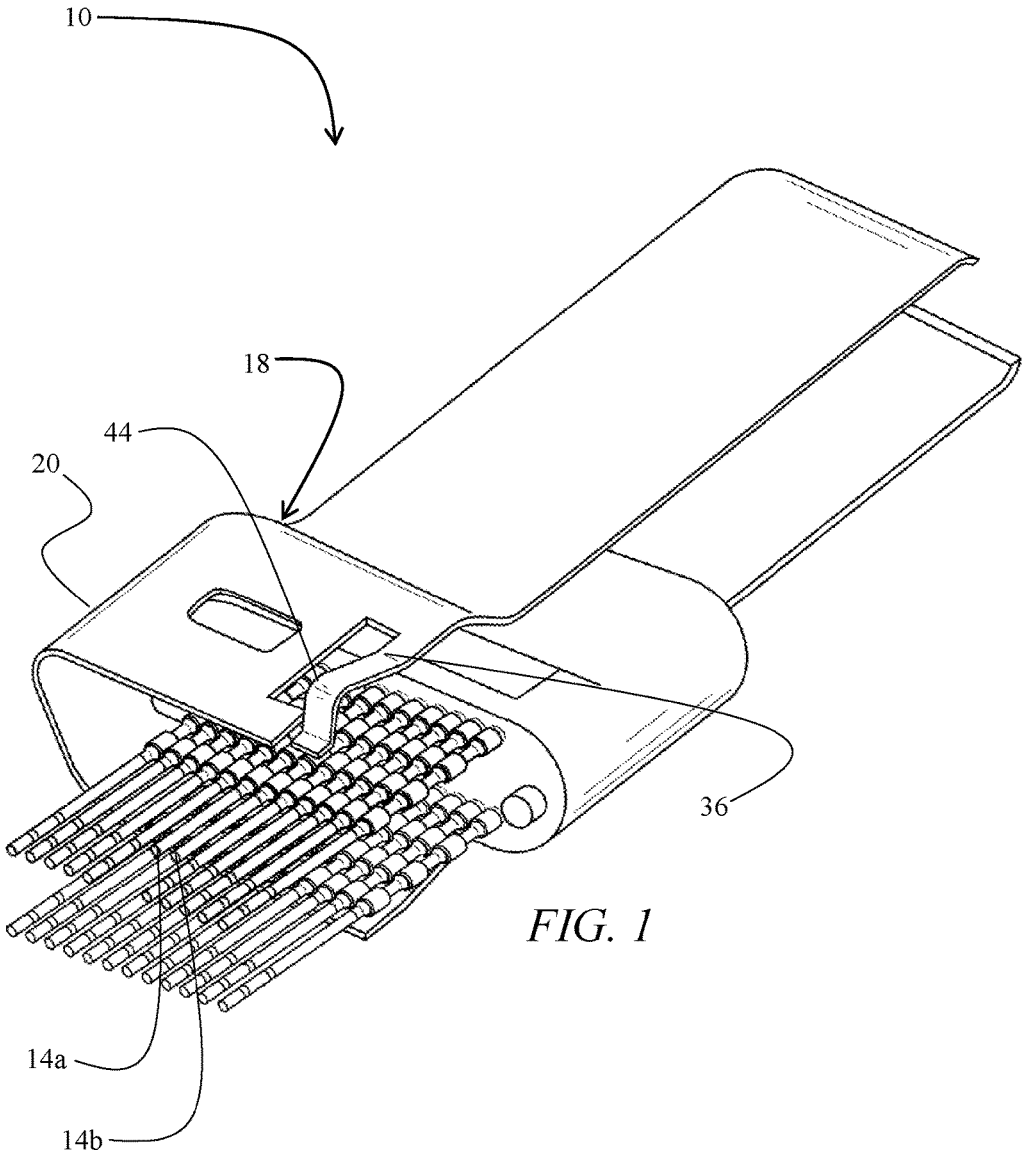
FIG. 1 is a perspective view of the male plug of the anti-theft device.
Figure 2:
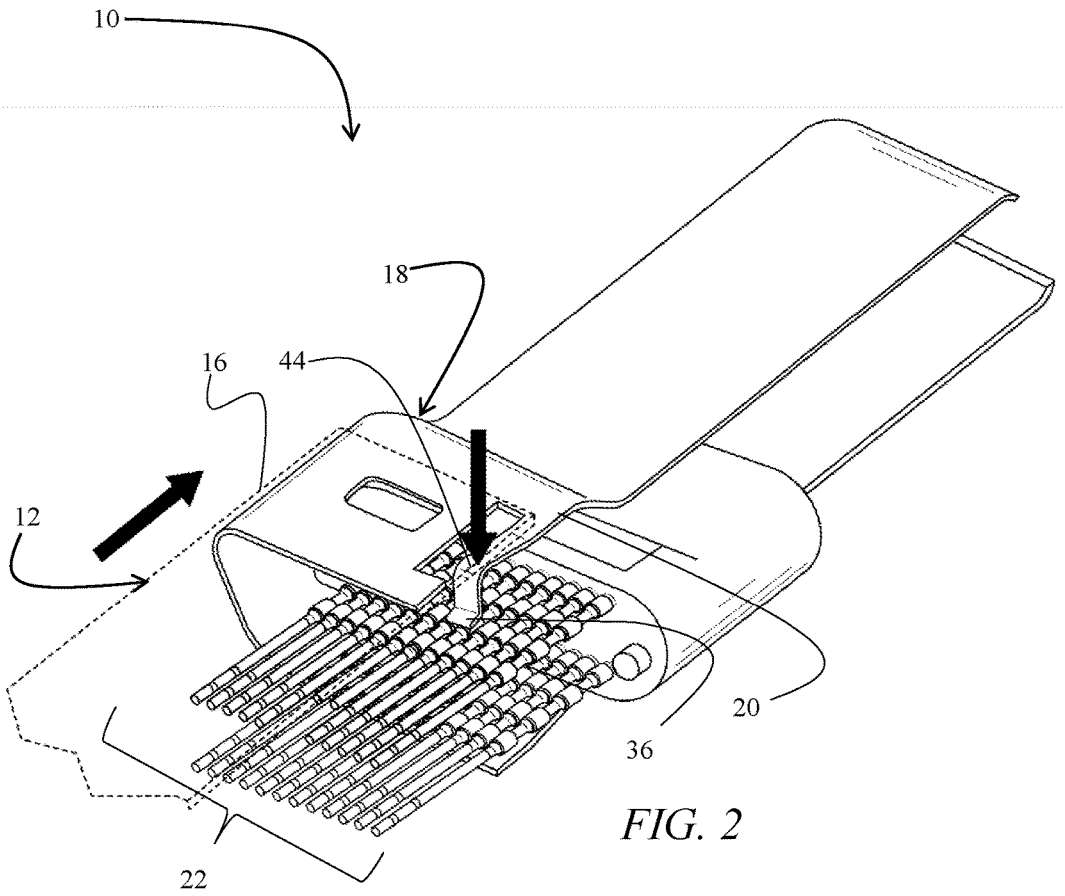
FIG. 2 is a perspective view illustrating the transitioning of the tongue from a first retracted position into a second displaced position when the plug is inserted into the female receptacle.

Referring to FIGS. 1 and 2, the invention involves an anti-theft device 10 for monitoring an electronic device having a female USB receptacle 12. In one embodiment, receptacle 12 is a Type C USB receptacle. Receptacle 12 includes a plurality of electrical contacts partially enclosed by a conductive shell 16. A male plug 18 is adapted for insertion into receptacle 12. Plug 18 has a sheath 20 enclosing a plurality of conductive pins 22. In the embodiment depicted in FIG. 1, plug 18 is configured for insertion into Type C USB receptacle 12. In this embodiment, plug 18 contains two rows of longitudinally extending contact pins 22, each row consisting of twelve pins 22. In other embodiments of the invention, the number of pins 22 may vary depending on the type of the USB connector.

Figure 3:
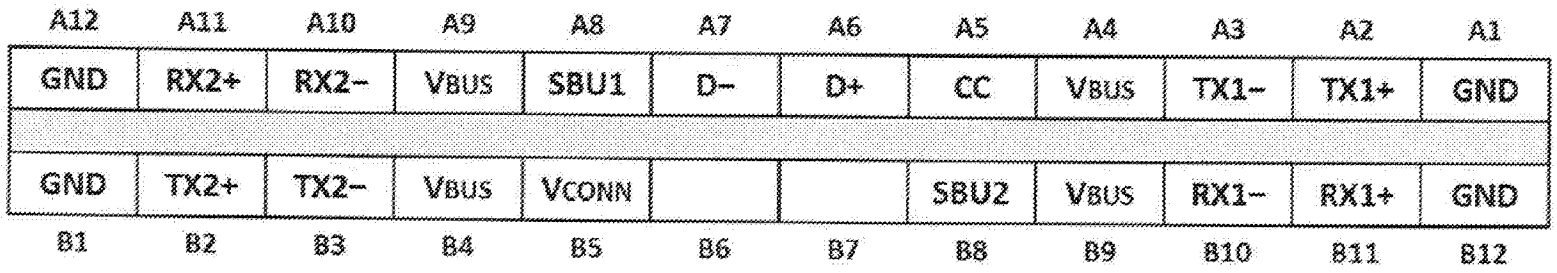
FIG. 3 is a pinout diagram of the male plug of the Type C USB connector.
Figure 4:
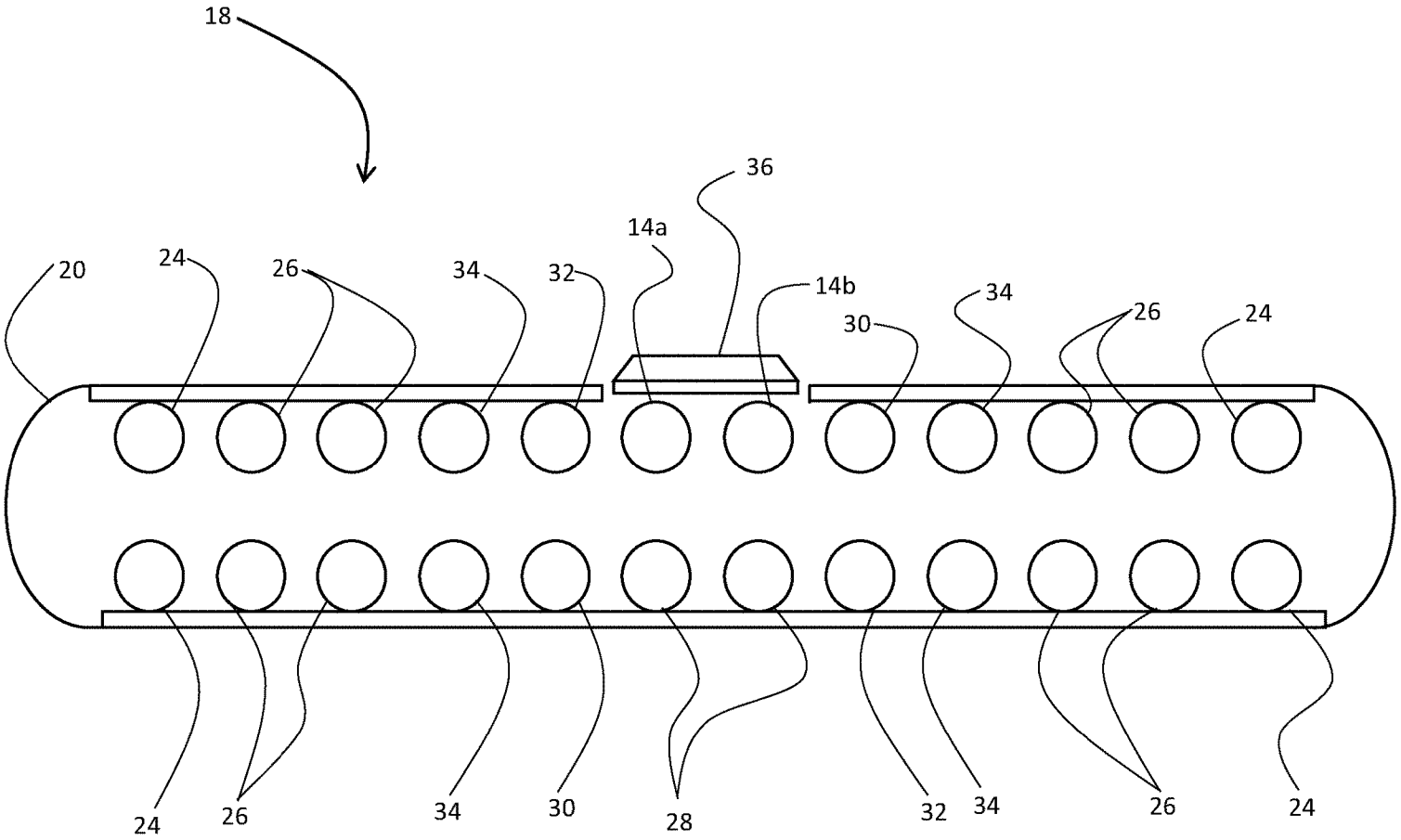
FIG. 4 is a schematic front view depicting the pins of the male plug.

As depicted in FIG. 1, a plurality of pins 22 are longitudinally disposed within sheath 20 of plug 18. In the embodiment configured for Type C USB connectors, there are twenty-four pins 22. The pinout diagram of a Type C USB plug is depicted in FIG. 3. The front view of plug 18 is provided in FIG. 4, which illustrates the following pin arrangement: there are four ground pins 24, four pairs of pins for high-speed data bus 26, two pins for USB 2.0 data bus 28, two sideband use pins 30, two configuration pins 32 for cable orientation detection, and four pins for cable bus power 34, and two pins 14*a* and 14*b* that are not designated to establish electrical connection with the electrical contacts of the female receptacle (although some versions of Type C USB may use pin 14*a* and 14*b* to enable reverse-compatibility between devices equipped with Type C USB receptor 12 and devices using USB 2.0 interface). As depicted in FIG. 1, pins 14*a* and 14*b* may be shorter than the rest of pins 22—in this configuration, pins 14*a* and 14*b* do not engage any electrical contacts within female receptacle 12.

As depicted in FIGS. 1 and 2, anti-theft device 10 repurposes pins 14*a* and 14*b*, using them for monitoring the connection between male plug 18 and receptacle 12 as disclosed below. The remaining pins 22 are used for their intended purposes, thereby allowing the electronic device being monitored by anti-theft device 10 to remain fully powered and to communicate with other electronic devices connected thereto via the USB connector. This feature of anti-theft device 10 enables an electronic device to be interactively displayed at the counter without diminishing its functionality, while securing it against theft.

Plug 18 includes a tongue 36 positioned over both pins 14*a* and 14*b*. Tongue 36 may be integrated within sheath 20, as depicted in FIGS. 1 and 2, or, alternatively, it may be hingedly or otherwise pivotally or movingly attached to sheath 20. Tongue 36 has a first retracted position depicted in FIG. 1, in which tongue 36 does not contact pins 14*a* and 14*b*, and a second displaced position, in which tongue 36 simultaneously engages both pins 14*a* and 14*b*. Tongue 36 is biased toward the first retracted position away from contact pins 14*a* and 14*b*.

Figure 5:
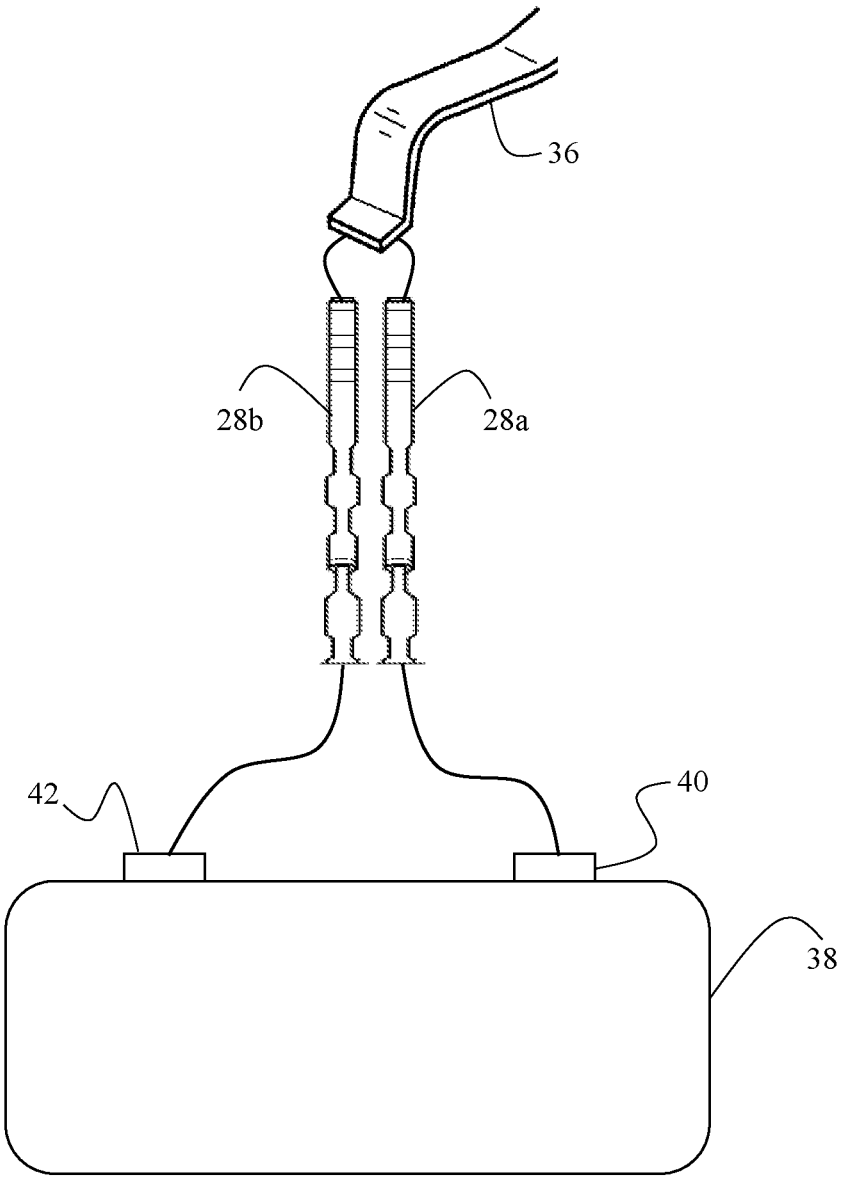
FIG. 5 is a schematic diagram depicting a closed electric circuit being monitored by an alarm module, the electric circuit formed between the pins and the tongue.

As FIG. 5 illustrates, anti-theft device 10 includes an alarm module 38 having a first terminal 40 and a second terminal 42. Alarm module 38 is configured to supply an electric current to first terminal 40. Pin 14*a* is in electrical communication with first terminal 40, while pin 14*b* is in electrical communication with second terminal 42. When tongue 36 is in its first retracted position, there is no electrical connection between pins 14*a* and 14*b*, and therefore, there is no electric current flowing to second terminal 42 of alarm module 38. At least the portion of tongue 36 contacting pins 14*a* and 14*b* is electrically conductive. Accordingly, when tongue 36 is in its second displaced position, the tongue 36 bridges pins 14*a* and 14*b* enabling electric current to flow between them, thereby closing an electric circuit between first and second terminals 40 and 42 of alarm module 36.

The electric circuit being monitored by module 36 in this embodiment of anti-theft device 10 is schematically illustrated in FIG. 5. The electric circuit is as follows: 1) current flows from first terminal 40 to conductive pin 14*a;* 2) from pin 14*a* to tongue 36; 3) from tongue 36 to conductive pin 14*b*; and 4) from pin 14*b* to second terminal 42 of alarm module 38, thereby closing an electric circuit. The circuit remains closed while plug 18 remains within receptacle 12. When plug 18 is removed from receptacle 12, the contact between pins 14*a*, 14*b*, and tongue 36 terminates. This event breaks the electron flow between first and second terminals 40 and 42 of alarm module 38, thereby triggering an alarm.

A circuitry is disposed within alarm module 38. The circuitry is in electrical communication with first and second terminals 40 and 42 of alarm module 38 and is used by alarm module 36 to detect interruptions in the electron flow between first and second terminals 40 and 42. Upon detection of an interruption of the electron flow, alarm module 38 transmits an alarm signal. The alarm signal is intended to alert the store staff about potential unauthorized activity or a theft attempt. The alarm signal may be audible, visual, or may be a communication to an appropriate party via any means known in the art, including an automated phone call, text message, or an email.

FIG. 2 illustrates how tongue 36 transitions from its first retracted position into its second displaced position. Tongue 36 has a protrusion 44 extending beyond the top surface of sheath 20. Protrusion 44 slopes down toward the free end of tongue 36. Tongue 36 is in its retracted position when plug 18 is outside the female receptacle. As plug 18 is inserted into the receptacle 12, shell 16 of receptacle 12 engages the sloped portion of protrusion 44. As sheath 20 continues to slide into shell 16, protrusion 44 is pressed downward, thereby displacing the tongue 36 toward pins 14*a* and 14*b*. When plug 18 is fully inserted into receptacle 12, the free end of tongue 36 is transitioned into its second displaced position, in which tongue 36 bridges pins 14*a* and 14*b*. Tongue 36 is conductive, thus allowing electric current to flow between pins 14*a* and 14*b*. This electric current flow is monitored by alarm module 38.

In the embodiment depicted in FIGS. 1 and 2, tongue 36 is integrated within sheath 20 of plug 18. Insertion of plug 18 into receptacle 12 causes tongue 36 to undergo elastic deformation, but does not cause any plastic deformation. Accordingly, when plug 18 is removed from receptacle 12, tongue 36 disengages pins 14*a* and 14*b* returning into its first retracted position. Thus, removal of plug 18 from receptacle 12 breaks the electrical communication between pins 14*a* and 14*b*. This causes electric current to stop flowing between terminals 40 and 42 of alarm module 38. Responsive to interruption in electric current flow between terminals 40 and 42, alarm module 38 transmits an alarm signal. Consequently, removal of plug 18 of anti-theft device 10 from receptacle 12 while alarm module 38 is armed will trigger an alarm signal to alert the store staff about potential unauthorized activity or a theft attempt.

In an alternative embodiment, tongue 36 is not integrated within sheath 20. In this embodiment, a biasing element—such as a spring, a tine, an elastomer member, etc.—is used to urge tongue 36 toward its first retracted position. Operation of anti-theft device 10 remains unchanged.

Figure 6:
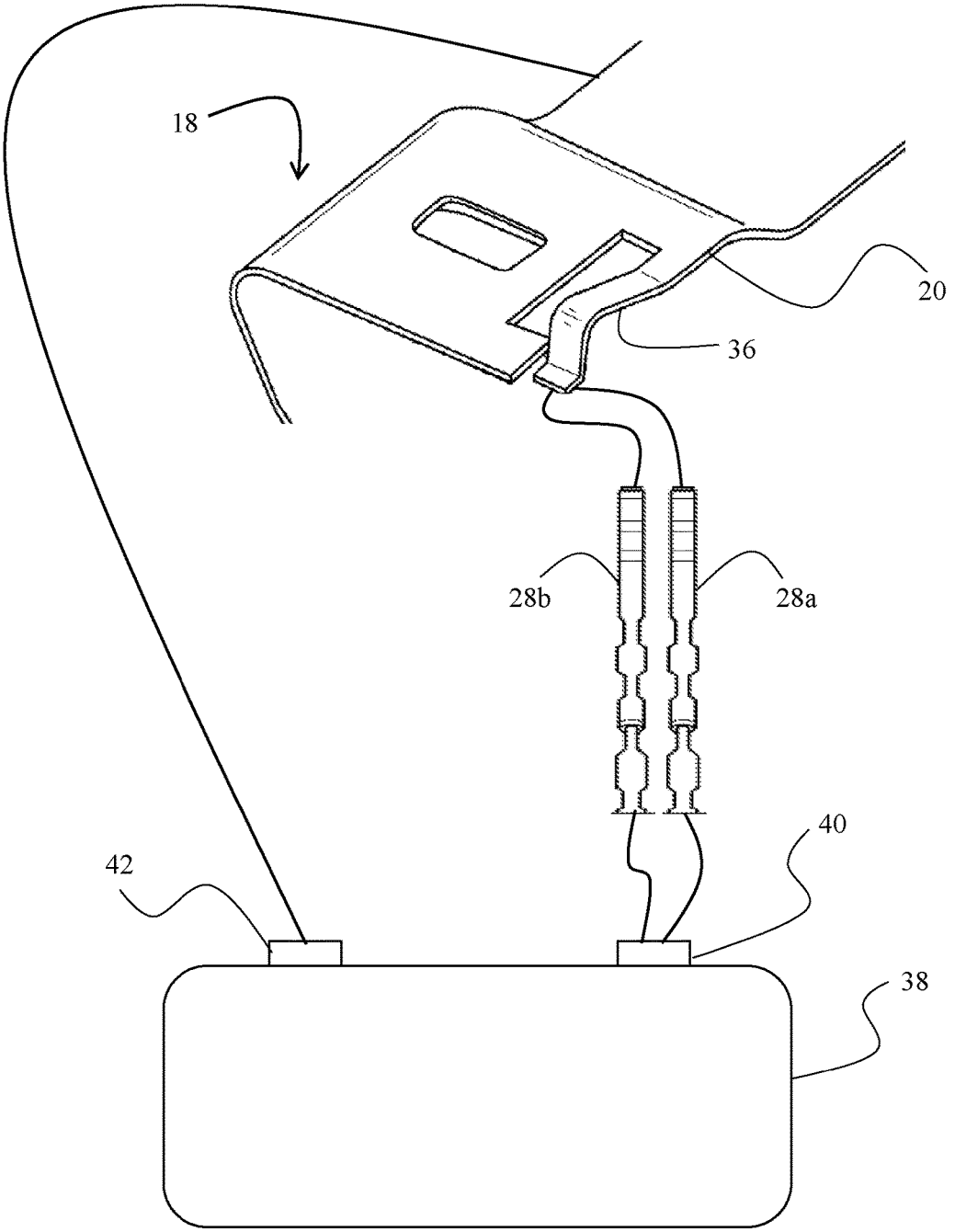
FIG. 6 is a schematic diagram depicting a closed electric circuit being monitored by an alarm module, the electric circuit formed between the pin, the tongue, and the sheath of the male plug.

In yet another embodiment, schematically illustrated in FIG. 6, both conductive pins 14*a* and 14*b* are in electrical communication with first terminal 40 of alarm module 38. In this embodiment, sheath 20 is electrically conductive and tongue 36 is either integrated within sheath 20, as depicted in FIGS. 1 and 2, or otherwise conductively connected to it. Sheath 20 of plug 18 is in electrical communication with second terminal 42 of alarm module 38. In this embodiment, the electric current flows from first terminal 40 to second terminal 42 of alarm module 38 as follows: 1) from pin 14*a* and/or pin 14*b* to tongue 36; 2) from tongue 36 to sheath 20 of plug 18; and 3) from sheath 20 of plug 18 to second terminal 42 of alarm module 38, thereby creating a closed circuit. Since both pins 14*a* and 14*b* are conductive, a certain amount of movement of plug 18 within receptacle 12 is permissible without triggering the alarm because even if one of pins 14*a* or 14*b* breaks connection with tongue 36, the alarm will not be triggered so long as at least one of pins 14*a* or 14*b* maintains the connection with tongue 36. Therefore, this embodiment provides a benefit of reducing the instances of false alarms. Alternatively, tongue 36 may engage only one pin.

The invention is unobtrusive and allows the customers to fully interact with the gadget. Furthermore, the invention may be used in conjunction with other anti-theft measures, including various brackets and security sensors attached to the gadget. The invention may supply electric current to the gadget through the USB connection to power the gadget, thereby allowing for continuous demonstrations without a need to recharge.

GLOSSARY OF THE CLAIM TERMS

Alarm module—a component of the anti-theft device configured to monitor the flow of an electric current between its first and second terminals when the male plug is inserted into the female receptacle. The alarm module is configured to transmit an alarm signal in response to detecting an interruption in the electron flow between the first and second terminals.

Female receptacle—a port generally residing within an electronic gadget configured to accept a corresponding male plug. Female receptacle generally comprises a shell and a plurality of electrical contacts disposed within the shell. The female receptacle is used for transferring data to and from the electronic gadget, supplying electric current to the electronic gadget, and allowing the electronic gadget to communicate with other electronic devices.

Electrical contact—an electrically conductive member disposed within the shell of the female receptacle configured to engage a corresponding conductive pin of the male plug to establish an electrical communication therewith.

Male plug—a component intended for insertion into a corresponding female receptacle. The male plug comprises a sheath and a plurality of conductive pins disposed within the sheath. The male plug is configured for insertion into the female receptacle. In the inserted configuration, the conductive pins of the male plug are in electrical communication with the electrical contacts of the female receptacle, and the sheath of the male plug is in electrical communication with the shell of the female receptacle.

Pin—an electrically conductive member disposed within the sheath of the male plug configured to engage a corresponding electrical contact of the female receptacle to establish an electrical communication therewith.

Sheath—a metal casing of the male plug partially enclosing the conductive pins disposed therein. The sheath is configured for insertion into the shell of the female port, wherein the sheath and the shell establish electrical communication with one another when the male port resides within the female receptacle.

Shell—a metal casing of the female receptacle partially enclosing the electrical contacts. The shell is configured to receive the sheath of the male plug making an electrical contact therewith.

Terminal (of an alarm module)—an electrically-conductive member of an alarm module in electrical communication with the circuitry disposed therein. The alarm module monitors the flow of electric current between the first terminal and the second terminal and transmits an alarm signal in response to interruption in the electron flow between the two terminals.

Tongue—a displaceable member having at least one free end which transitions between a first retracted configuration and a second displaced configuration. The tongue may either be integrated within the sheath or hingedly or movingly attached thereto.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

What is claimed is:

1. An anti-theft device for monitoring an electronic device having a female receptacle, comprising:

an alarm module having a first terminal and a second terminal;

a male plug having a sheath;

a plurality of conductive pins disposed within the sheath;

a first pin of the plurality of conductive pins being in electrical communication with the first terminal of the alarm module;

a second pin of the plurality of conductive pins being in electrical communication with the second terminal of the alarm module;

a tongue having an electrically conductive surface, wherein the tongue has a first retracted position in which the conductive surface is retracted away from the first and the second pins and a second displaced position in which the conductive surface engages the first and the second pins thereby enabling the electric current to flow therebetween, the tongue being biased toward the first retracted position;

wherein insertion of the male plug into the female receptacle transitions the tongue into the second displaced position in which the conductive surface of the tongue becomes an electrical conduit between the first and the second pins;

whereby the alarm module transmits an alarm signal responsive to detecting an interruption in the flow of the electric current between the first and the second terminals.

2. The anti-theft device according to claim 1, wherein the tongue has a first end affixed to the sheath and a second free end.

3. The anti-theft device according to claim 1, wherein the tongue has a sloped raised portion protruding beyond an outer surface of the sheath, whereby insertion of the male plug into the female receptacle causes a shell of the female receptacle to exert a force onto the sloped raised portion sufficient to transition the tongue into the second displaced position.

4. The anti-theft device according to claim 1, wherein insertion of the male plug into a female receptacle elastically deforms the tongue.

5. The anti-theft device according to claim 1, wherein the tongue transitions into the first retracted position upon removal of the male plug from the female receptacle.

6. The anti-theft device according to claim 1, wherein the male plug is configured for connection with a Type C universal serial bus (USB) female receptacle.

7. The anti-theft device according to claim 1, wherein the first and the second pins do not engage the electrical contacts of the female receptacle when the male plug is inserted into the female receptacle.

8. An anti-theft device for monitoring an electronic device having a Type C universal serial bus female receptacle, comprising:

an alarm module having a first terminal and a second terminal;

a male plug having a sheath;

a plurality of conductive pins disposed within the sheath;

a first pin of the plurality of conductive pins being in electrical communication with the first terminal of the alarm module;

a second pin of the plurality of conductive pins being in electrical communication with the second terminal of the alarm module;

a tongue having a first end integrated within the sheath and a second free end detached from the sheath, the second end being electrically conductive, wherein the tongue has a first retracted position in which the second end is retracted away from the first and the second pins and a second displaced position in which the second end engages the first and the second pins thereby enabling the electric current to flow therebetween, the tongue being biased toward the first retracted position;

wherein insertion of the male plug into the female receptacle elastically deforms the tongue, thereby transitioning the tongue into the second displaced position in which the second end of the tongue becomes an electrical conduit between the first and the second pins;

whereby removal of the male plug from the female receptacle causes the tongue to transition into the first retracted position breaking electrical connection between the first and the second pins, thereby causing the alarm module to transmit an alarm signal.

9. The anti-theft device according to claim 8, wherein the tongue has a sloped raised portion protruding beyond an outer surface of the sheath, whereby insertion of the male plug into the female receptacle causes a shell of the female receptacle to exert a force onto the sloped raised portion sufficient to transition the tongue into the second displaced position.

10. The anti-theft device according to claim 8, wherein the first and the second pins do not engage the electrical contacts of the female receptacle.

11. An anti-theft device for monitoring an electric device having a female receptacle, comprising:

an alarm module having a first terminal and a second terminal;

a male plug having a sheath, the sheath being in electrically conductive, wherein the sheath is in electrical communication with the second terminal of the alarm module;

a plurality of conductive pins disposed within the sheath;

a first pin of the plurality of conductive pins being in electrical communication with the first terminal of the alarm module;

a tongue in electrical communication with the sheath, the tongue being electrically conductive, wherein the tongue has a first retracted position in which the tongue is retracted away from the first pin and a second displaced position in which the tongue engages the first pin thereby establishing an electrical connection therewith, the tongue being biased toward the first retracted position;

wherein insertion of the male plug into the female receptacle transitions the tongue into the second displaced position, in which the tongue is in electrical communication with the first pin, thereby creating a closed electric circuit between the first and the second terminals of the alarm module;

whereby the alarm module is configured to transmit an alarm signal responsive to detecting an interruption in the flow of an electric current between the first and the second terminals.

12. The anti-theft device according to claim 11, wherein the tongue has a sloped raised portion protruding beyond an outer surface of the sheath, whereby insertion of the male plug into the female receptacle causes a shell of the female receptacle to exert a force onto the sloped raised portion sufficient to transition the tongue into the second displaced position.

13. The anti-theft device according to claim 11, wherein the tongue has a first end affixed to the sheath and a second free end.

14. The anti-theft device according to claim 11, wherein insertion of the male plug into a female receptacle elastically deforms the tongue.

15. The anti-theft device according to claim 11, wherein the tongue transitions into the first retracted position upon removal of the male plug from the female receptacle.

16. The anti-theft device according to claim 11, wherein the male plug is configured for insertion into a Type C universal serial bus (USB) female receptacle.

17. The anti-theft device according to claim 11, wherein the first pin does not engage the electrical contacts of the female receptacle.

* * * * *